US005149151A

United States Patent [19]

Shen

[11] Patent Number: 5,149,151

[45] Date of Patent: Sep. 22, 1992

[54] ADJUSTABLE LATCH ASSEMBLY OF LEVER LOCK

[76] Inventor: Chao C. Shen, No. 62, Hoshan St., Tainan, Taiwan, TWX

[21] Appl. No.: 750,328

[22] Filed: Aug. 27, 1991

[51] Int. Cl.[5] ..... E05C 1/16

[52] U.S. Cl. ..... 292/1.5; 292/DIG. 60; 292/166; 292/337

[58] Field of Search ..... 292/1.5, 337, DIG. 60, 292/173, 166

[56] References Cited

U.S. PATENT DOCUMENTS 4,890,871 1/1990 Lin ..... 292/1.5 X
4,957,315 9/1990 Lin ..... 292/1.5 X
5,074,605 12/1991 Fann et al. ..... 292/1.5 X

*Primary Examiner*—Richard E. Moore
*Attorney, Agent, or Firm*—Peterson, Wicks, Nemer & Kamrath

[57] ABSTRACT

An adjustable latch assembly used in a lever lock comprises a shell, a shelf, a rotator, an actuating arm, a positioning and pulling assembly, and a bolt. The shell is attachable to a door. The shelf has a first position and a second position within the shell. The rotator is mountable on the shelf. The actuating arm co-operates with the rotator, so as to be actuated by the rotator when the rotator rotates. The positioning and pulling assembly positions the shelf in the first position or the second position and pulls the bolt inward. The adjustable latch assembly has a first backset when the shelf is at the first position and a second backset when shelf is at a second position.

5 Claims, 5 Drawing Sheets

ADJUSTABLE LATCH ASSEMBLY OF LEVER LOCK

BACKGROUND OF THE INVENTION

This invention relates to a latch assembly used in a lever lock, particularly a latch assembly with an adjustable backset.

Conventionally, a lever lock is fixed to a door and includes a handle, a square spindle attached to the handle, and a latch assembly including a bolt which is slideable within the latch assembly. The handle rotates the spindle while the spindle drives the bolt. When in a locked position, the bolt is received in a strike attached to a jamb, so that the door is locked.

Generally, a door includes a bore through which the spindle is inserted. A backset is a distance between a center of the bore to a door edge. There are two standard backsets. The first standard backset is 60 mm. The second standard backsets is 70 mm. Therefore, a lockmaker has to manufacture two types of latches with different standard backsets, and a locksmith has to bring two types of latches with different backsets, and this is very inconvenient.

It is the purpose of the present invention, therefore, to mitigate and/or obviate the above-mentioned drawback in the manner set forth in the detailed description of the preferred embodiment.

SUMMARY OF THE INVENTION

It is an object of the present invention to provide a adjustable latch assembly which includes an adjustable backset.

This and additional objects, if not specifically set forth herein, will be readily apparent to those skilled in the art from the detailed description provided hereunder, with appropriate reference to the accompanying drawing.

DETAILED DESCRIPTION OF THE PREFERRED EMBODIMENT

Figure 1:
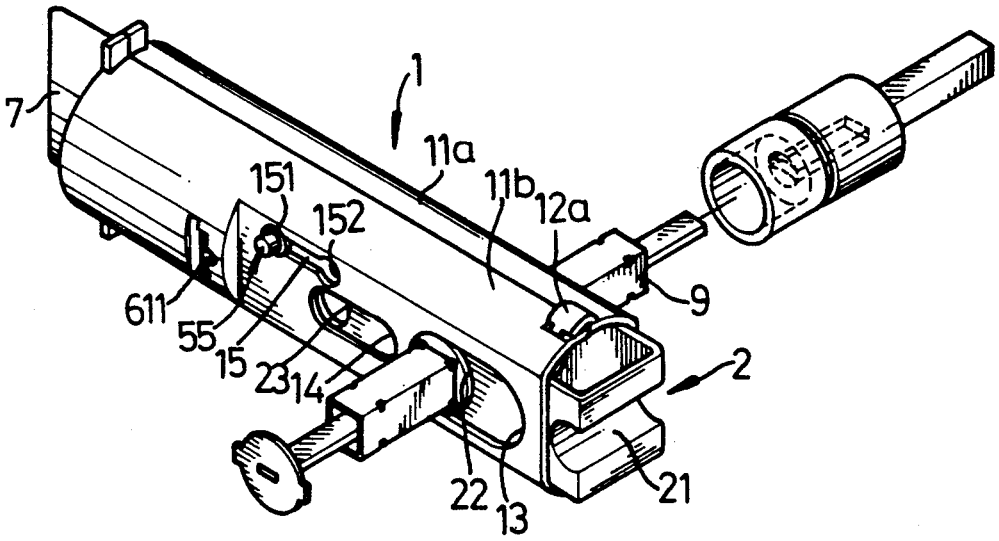
FIG. 1 is a perspective view of an adjustable latch assembly in accordance with the present invention.
Figure 7:
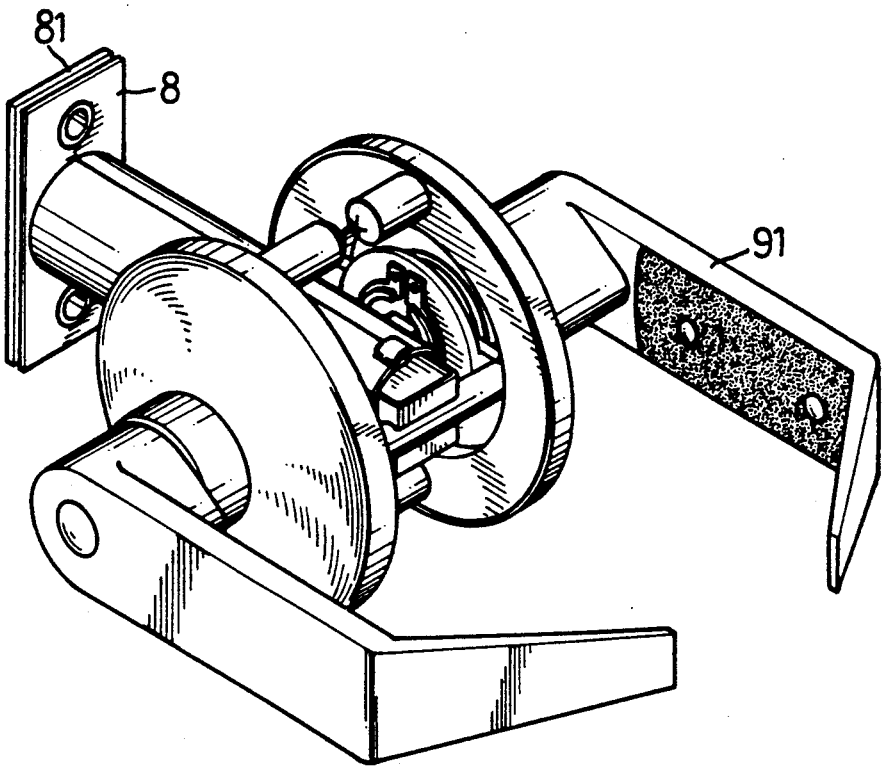
FIG. 7 is perspective view of a lever lock including an adjustable latch assembly in accordance with the present invention.

Referring to FIGS. 1 and 7, an adjustable latch assembly, including a bolt 7, co-operates with a rectangular spindle 9 which further engages with a handle 91. When the handle 91 is released, the bolt 7 is in a locked position, where the bolt 7 is received in a strike (not shown), thereby locking a door. When the handle 91 is turned, the bolt 7 is withdrawn from the strike, thereby unlocking the door.

Figure 2:
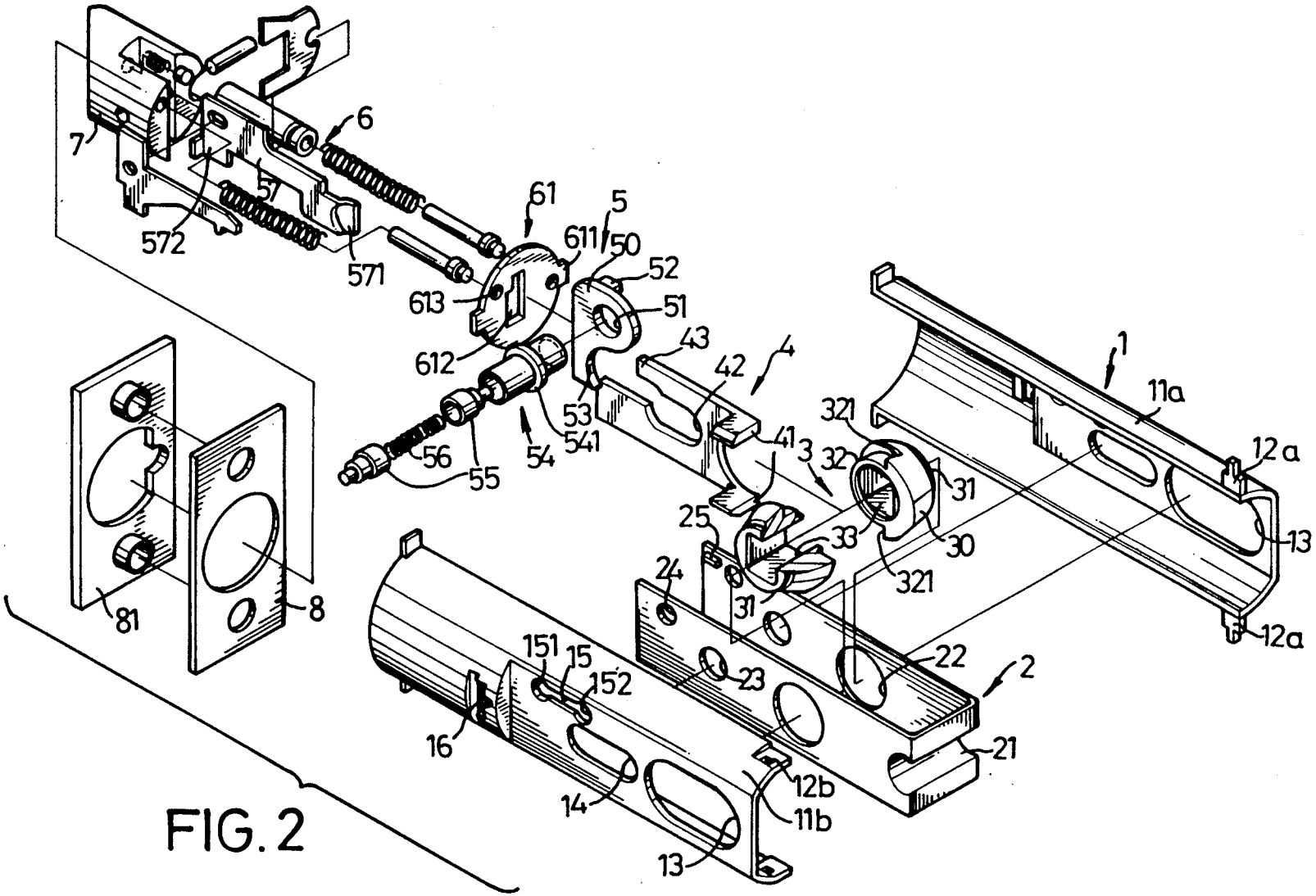
FIG. 2 is an exploded view of an adjustable latch assembly in accordance with the present invention.
Figure 3:
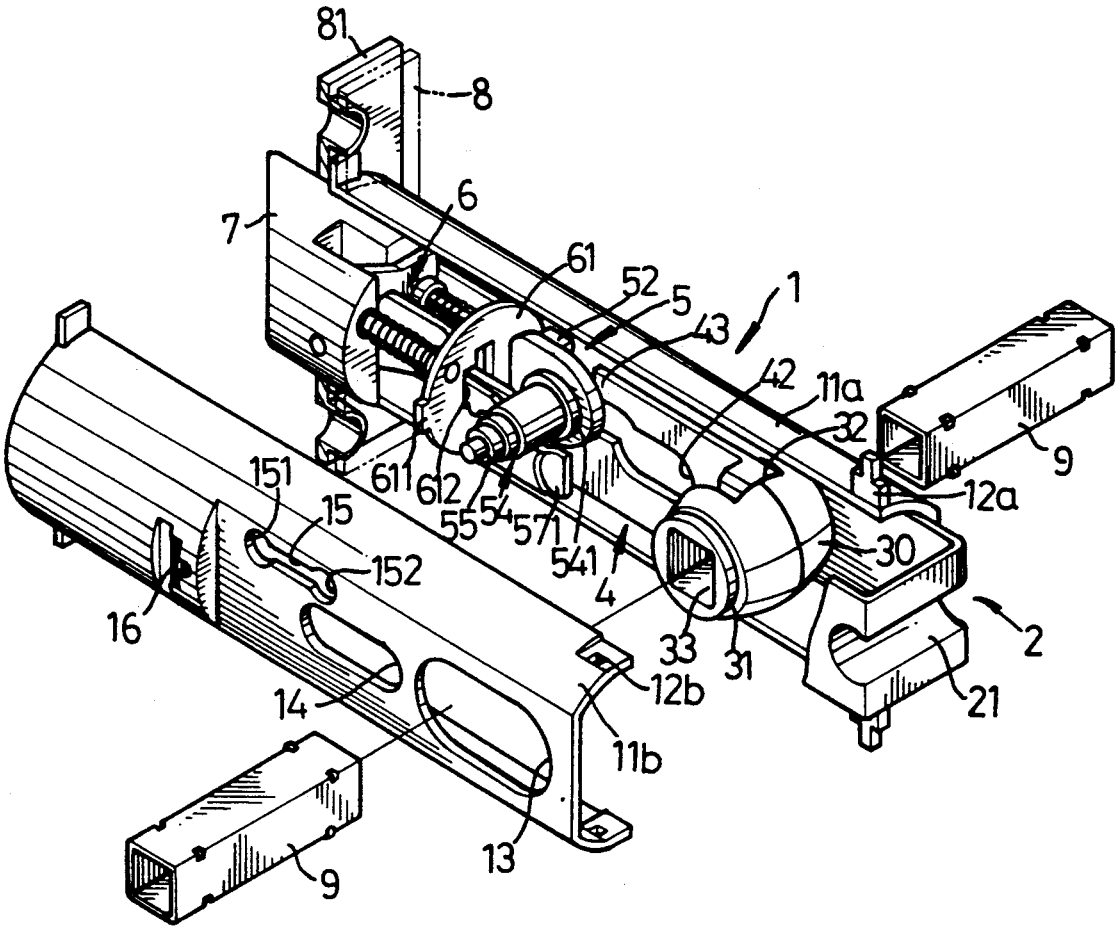
FIG. 3 is a partially exploded view of an adjustable latch assembly in accordance with the present invention.

Referring to FIGS. 2 and 3, the adjustable latch assembly includes a shell 1 including sections 11*a* and 11*b*. The section 11*a* includes an engaging element 12*a* on a top edge and a bottom edge thereof. The section 11*b* includes an engaging hole 12*b* in which the engaging element 12*a* is receivable, thereby assembling the sections 11*a* and 11*b* into the shell 11. Both the sections 11*a* and 11*b* include a slot 13, a slot 14 aligning with the slot 13, a slot 15 residing parallel to the slot 14, and a slot 16 lying perpendicular to the slot 15. The slot 15 communicates holes 151 and 152.

A U-shaped shelf 2 includes a closed end formed with a channel 21 and two parallel walls each including a hole 22 corresponding to the slot 13, a hole 23 corresponding to the slot 14, a hole 24 corresponding to the slot 15, and a stop 25 facing inwardly.

A cylindrical rotator 3 includes two sections 30 mating each other and being rotatable relative to each other. Each section 30 includes an end 32 being insertable through a corresponding hole 22 and slideable in a corresponding slot 13, a relatively small semi-cylindrical portion 32 defining two faces 321, and a square tunnel 33 extending therethrough.

An actuating element 4 includes a semi-circular cut-off corresponding to the semi-cylindrical portion 32, two tabs 41 each abutting a corresponding face 321, a slot 42 extending partly a backset thereof, and a pushing arm 43.

A positioning and pulling assembly 5 includes a trigger element 50 including a hole 51, a tab 52 formed on a first side thereof, and a hook portion 53. A cylindrical shaft 54 is insertable through the hole 51, so that the shaft 54 is rotatable on the shaft 54, and includes a peripheral flange 541, so that the trigger element 50 is remained between the flange 541 and the actuating element 4. Two discretely tapered caps 55 sandwich a spring 56 and are receivable in the shaft 54. Each of the caps 55 is insertable through a corresponding hole 24 and receivable in a corresponding hole 151 or 152, so that the shaft 54 is mountable on the shell 1 while the trigger-like element 50 is rotatable on the shaft 54. A pulling bar 57 includes a first end 571 hooked on the hook portion 53 and a second end 572 fixed to a bolt 7.

A spring-projecting and guard-bolt assembly 6 is employed for urging the bolt 7 to the locked position when a handle is released and for deadlocking the adjustable latch assembly 1 when disturbed by an unauthorized person. A plate 61 includes two lugs 611 each being receivable in a corresponding slot 16, a slot 612 through which the pulling bar 57 is insertable, and two holes 613 each formed on a side of the slot 612. The spring-projecting and guard-bolt assembly 6 is arranged between the plate 61 and the bolt 7 and needs no detailed description as it is described in prior art.

Figure 4:
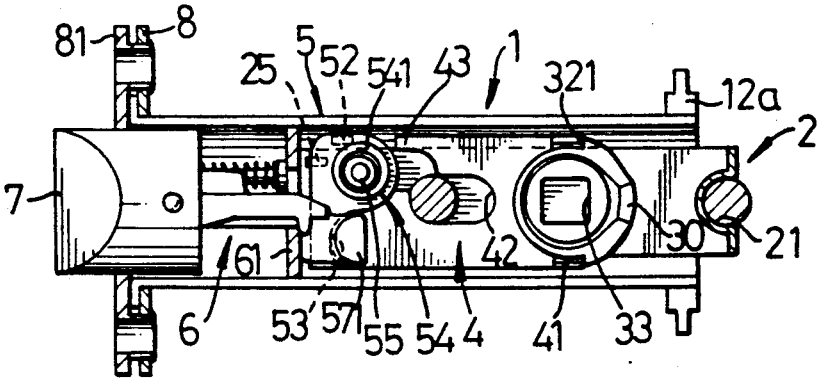
FIG. 4 is a side view of an adjustable latch assembly when being of a first backset and a bolt being in a locked position in accordance with the present invention.

Referring to FIG. 4, each of the caps 55 is received in a corresponding hole 151. The hook portion 53 hooks the end 571. The backset is 60 mm.

Figure 5:
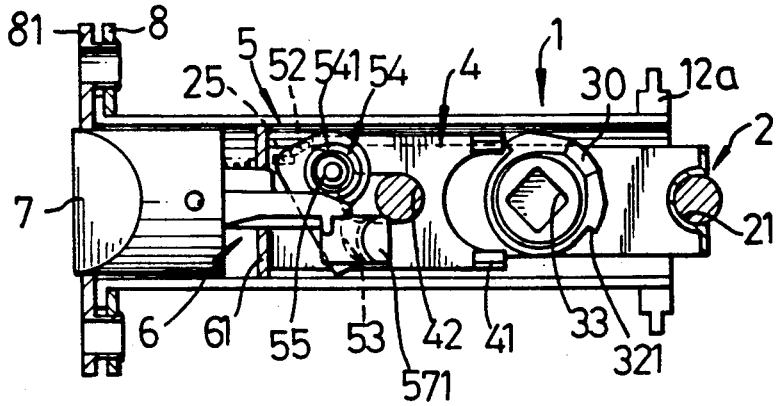
FIG. 5 is a side view of an adjustable latch assembly when being of a first backset and a bolt being in an unlocked position in accordance with the present invention.

Referring to FIG. 5, one of the rectangular spindles 9 is rotated, as well as is the rotator 31. One of the faces 321 pushes a corresponding tab 41. The pushing arm 43 urges the tab 52 leftward, thereby rotating the trigger-like element 50 counter-clockwise. The hook portion 53 urges the end 571 rightward, thereby pulling the bolt 7 toward the inner shell 2, thereby allowing the door to be opened.

Figure 6:
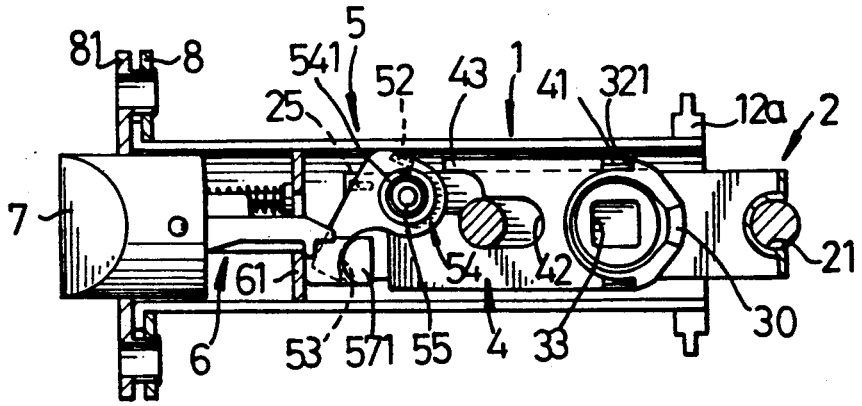
FIG. 6 is a side view of an adjustable latch assembly when being of a second backset and a bolt being in a locked position in accordance with the present invention.

Referring to FIG. 6, each of the caps 55 is depressed and removed from the hole 151 to reside in a corresponding hole 152. The hook portion 53 still hooks the end 571. The backset is 70 mm. Each of the caps 55 can be depressed and removed from the hole 152 to reside in the hole 151, thereby setting the backset back to 60 mm again.

While the present invention has been explained in relation to its preferred embodiment, it is to be understood that various variations thereof will be apparent to those skilled in the art upon reading this specification. Therefore, the invention disclosed herein is intended to cover all such variation as shall fall within the scope of the appended claims.

I claim:

1. An adjustable latch assembly used in a lever lock, comprising:

a shell having two sections each having a first slot through which a spindle penetrates, a second slot through which a pin penetrates for securing said latch assembly to a door, a third slot communicating with two holes at two ends, and a fourth slot extending perpendicular to said first, second, and third slots:

a shelf having a first position and a second position within said shell;

a rotator mountable on said shelf;

actuating means actuatable by said rotator;

a bolt; and a positioning and pulling assembly for retaining said shelf in said first position or said second position and for pulling said bolt into said shell when actuated by said actuating means.

2. An adjustable latch assembly in accordance with claim 1, wherein said shelf comprises an end wall integrally connecting with two opposite walls each having a first hole corresponding to said first slot of each said section of said shell, a second hole corresponding to said second slot of each said section of said shell, and a third hole corresponding to said third slot of each said section of said shell.

3. An adjustable latch assembly in accordance with claim 2, wherein said rotator comprises two sections each having an end rotatably received in each said first hole of said shelf, a relatively small semi-cylindrical portion defining two faces, and a tunnel extending therethrough for receiving the spindle operatively attached to a handle.

4. An adjustable latch assembly in accordance with claim 3, wherein said actuating means comprises at a first end an actuating arm and at a second end a semicircular cutoff matching said relatively small semicylindrical portion, whereby said rotator urges said actuating arm to move along a rectilinear path when rotated by the spindle.

5. An adjustable latch assembly in accordance with claim 4, wherein said positioning and pulling assembly comprises:

a cylindrical shaft;

two discretely tapered caps sandwiching a spring and being receivable in said shaft, each being insertable through a corresponding third hole of said shelf and receivable in said first hole or said second hole of said shell;

a trigger-like element having a hole through which said shaft is insertable and a tab protruding from a side thereof; and a pulling bar having a first end fixed to said bolt and a second end hooked on said trigger-like element, whereby said trigger-like element pulls said bolt into said shell by means of said pulling bar when said actuating arm urges said tab.

* * * * *